US007488414B2

(12) United States Patent
Wimberger

(10) Patent No.: US 7,488,414 B2
(45) **Date of Patent: *Feb. 10, 2009**

(54) STORM WATER FILTER FOR POSITIONING WITHIN A STORM WATER INLET

(76) Inventor: Brian J. Wimberger, 817 - 12th Ave. SE, Apt. 301, Minneapolis, MN (US) 55414

( * ) Notice: Subject to any disclaimer, the term of this patent is extended or adjusted under 35 U.S.C. 154(b) by 0 days.

This patent is subject to a terminal disclaimer.

(21) Appl. No.: 12/136,363

(22) Filed: Jun. 10, 2008

(65) Prior Publication Data

US 2008/0237100 A1 Oct. 2, 2008

Related U.S. Application Data

(63) Continuation of application No. 11/440,427, filed on May 24, 2006, now Pat. No. 7,396,471, which is a continuation of application No. 10/453,562, filed on Jun. 3, 2003, now Pat. No. 7,052,207, which is a continuation of application No. 09/756,565, filed on Jan. 8, 2001, now Pat. No. 6,609,852.

(51) Int. Cl.
*E03F 5/14* (2006.01)

(52) U.S. Cl. ..... 210/163; 210/164; 210/170.03; 210/434; 210/474; 404/4; 405/41

(58) Field of Classification Search ..... 210/163, 210/164, 165, 166, 170.03, 434, 474, 532.1, 210/747, 767; 404/4, 5; 405/36, 40, 41, 405/43

See application file for complete search history.

(56) References Cited

U.S. PATENT DOCUMENTS 693,511 A 2/1902 Garrett et al.
809,201 A 1/1906 Lutz
810,879 A 1/1906 Perry
902,289 A 10/1908 Gribben et al.
1,141,678 A 6/1915 Bailey
1,457,637 A 6/1923 Sievers
1,541,436 A 6/1925 Reshan
1,601,498 A 9/1926 Hirschstein (Continued)

FOREIGN PATENT DOCUMENTS

GB 2217364 10/1989

OTHER PUBLICATIONS

Defendant's (Lange Industries, Inc.) 103 Prior Art Statement—Civil Action No. 06-cv-3565 (PJS/RLE), in the U.S. District Court—District of Minnesota; filed Jan. 16, 2007.

(Continued)

*Primary Examiner*—Christopher Upton
(74) *Attorney, Agent, or Firm*—Westman, Champlin & Kelly, P.A.

(57) ABSTRACT

An erosion control basin is a molded open topped receptacle that has support flanges that will support the basin on the interior of a storm drain grate frame. A filter is formed around an upright perforated drain pipe that is on the interior of the basin and which opens to an outlet. The basin catches debris and silt but permits water to drain out. The top of the drainpipe is left open for overflow purposes.

19 Claims, 3 Drawing Sheets

U.S. PATENT DOCUMENTS

| | | | |
|---|---|---|---|
| 1,711,674 | A | 5/1929 | Egan |
| 1,812,583 | A | 6/1931 | Cavalieri |
| 1,993,534 | A | 3/1935 | Stoltz |
| 2,182,795 | A | 12/1939 | Day |
| 3,246,582 | A | 4/1966 | Wade et al. |
| 3,439,505 | A | 4/1969 | Martin |
| 3,665,526 | A | 5/1972 | Hoffman |
| 3,695,153 | A | 10/1972 | Dorris |
| 4,345,998 | A | 8/1982 | Graffis et al. |
| 4,419,232 | A | 12/1983 | Arntyr et al. |
| 5,032,264 | A | 7/1991 | Geiger |
| 5,297,895 | A | 3/1994 | Johnson |
| 5,383,318 | A | 1/1995 | Kelley et al. |
| 5,403,474 | A | 4/1995 | Emery |
| 5,405,539 | A | 4/1995 | Schneider |
| 5,486,287 | A | 1/1996 | Murphy et al. |
| 5,582,720 | A | 12/1996 | Deming |
| 5,744,048 | A | 4/1998 | Stetler |
| 5,843,306 | A | 12/1998 | Singleton |
| 5,849,198 | A | 12/1998 | Sharpless |
| 5,954,952 | A | 9/1999 | Strawser, Sr. |
| 5,980,740 | A | 11/1999 | Harms et al. |
| 6,017,166 | A | 1/2000 | Mossburg, Jr. |
| 6,062,767 | A | 5/2000 | Kizhnerman et al. |
| 6,086,758 | A | 7/2000 | Schilling et al. |
| 6,178,565 | B1 | 1/2001 | Franco |
| 6,214,216 | B1 | 4/2001 | Isaacson |
| 6,270,663 | B1 | 8/2001 | Happel |
| 6,274,036 | B1 | 8/2001 | Ellis |
| 6,287,459 | B1 | 9/2001 | Williamson |
| 6,294,095 | B1 | 9/2001 | Lewis |
| 6,306,293 | B1 | 10/2001 | Schilling et al. |
| 6,406,620 | B1 | 6/2002 | Rogers |
| 6,517,709 | B1 | 2/2003 | Cardwell et al. |
| 6,521,122 | B1 | 2/2003 | Elliot et al. |
| 6,531,059 | B1 | 3/2003 | Morris et al. |
| 6,537,446 | B1 | 3/2003 | Sanguinetti |
| 6,558,077 | B1 | 5/2003 | Colson |
| 6,609,852 | B2 | 8/2003 | Wimberger |

OTHER PUBLICATIONS

Defendant's (Lange Industries, Inc.) 102 Prior Art Statement—Civil Action No. 06-cv-3565 (PJS/RLE), in the U.S. District Court—District of Minnesota; filed Jan. 16, 2007.

Plaintiff's (Wimco, LLC) List of Claim Terms to be Construed, and Preliminary Identification of Extrinsic Evidence—Civil Action No. 06-cv-03565 (PJS/RLE), in the U.S. District Court—District of Minnesota; Document No. 16 filed Jan. 29, 2007.

Defendant's (Lange Industries, Inc.) List of Disputed Claim Terms—Civil Action No. 06-cv-03565 (PJS/RLE), in the U.S. District Court—District of Minnesota; filed Jan. 29, 2007.

Joint Claim Construction Statement—Civil Action No. 06-cv-03565 (PJS/RLE), in the U.S. District Court—District of Minnesota; Document No. 17 filed Feb. 6, 2007.

Defendant's (Lange Industries, Inc.) Preliminary Identification of Extrinsic Evidence—Civil Action No. 06-cv-03565 (PJS/RLE), in the U.S. District Court—District of Minnesota; filed Feb. 2, 2007.

Plaintiff's (Wimco, LLC) Prior Art Statement—Civil Action No. 06-cv-03565 (PJS/RLE), in the U.S. District Court—District of Minnesota; filed Feb. 16, 2007.

Plaintiff's (Wimco, LLC) Initial Brief in Support of Its Claim Construction—Civil Action No. 06-cv-03565 (PJS/RLE), in the U.S. District Court—District of Minnesota; Document No. 26 filed May 14, 2007.

Defendant's (Lange Industries, Inc.) Claim Construction Brief—Civil Action No. 06-cv-03565 (PJS/RLE), in the U.S. District Court—District of Minnesota; Document No. 28 filed May 14, 2007.

Declaration of Christopher R. Smith in Support of Defendant's Claim Construction Brief—Civil Action No. 06-cv-03565 (PJS/RLE), in the U.S. District Court—District of Minnesota; Document No. 29 filed May 14, 2007.

Declaration of Shane Lange in Support of Defendant's Claim Construction Brief—Civil Action No. 06-cv-03565 (PJS/RLE), in the U.S. District Court—District of Minnesota; Document No. 30 filed May 14, 2007.

Plaintiff's (Wimco, LLC) Reply Brief in Support of Its Claim Construction—Civil Action No. 06-cv-03565 (PJS/RLE), in the U.S. District Court—District of Minnesota; Document No. 35 filed Jun. 7, 2007.

Declaration of Nickolas E. Westman—Civil Action No. 06-cv-03565 (PJS/RLE), in the U.S. District Court—District of Minnesota; Document No. 38 filed Jun. 7, 2007.

Defendant's Response Claim Construction Brief—Civil Action No. 06-cv-03565 (PJS/RLE), in the U.S. District Court—District of Minnesota; Document No. 38 filed Jun. 7, 2007.

Complaint—Civil Action No. 06-cv-03565 (PJS/RLE), in the U.S. District Court—District of Minnesota; filed Sep. 1, 2006.

Answer and Counterclaim—Civil Action No. 06-cv-03565 (PJS/RLE), in the U.S. District Court—District of Minnesota; filed Sep. 26, 2006.

Reply to Counterclaim—Civil Action No. 06-cv-03565 (PJS/RLE), in the U.S. District Court—District of Minnesota; filed Oct. 9, 2006.

Plaintiff's (Wimco, LLC) Statement of The Case—Civil Action No. 06-cv-03565 (PJS/RLE), in the U.S. District Court—District of Minnesota; filed Nov. 15, 2006.

Lange Industries, Inc.'s Statement of the Case—Civil Action No. 06-cv-03565 (PJS/RLE), in the U.S. District Court—District of Minnesota; filed Nov. 16, 2006.

Markman Order—Civil Action No. 06-cv-03565 (PJS/RLE), in the U.S. District Court—District of Minnesota; filed Dec. 14, 2007.

STORM WATER FILTER FOR POSITIONING WITHIN A STORM WATER INLET

CROSS-REFERENCE TO RELATED APPLICATION

The present application is a continuation of and claims priority of U.S. patent application Ser. No. 11/440,427, filed May 24, 2006, which is a continuation of Ser. No. 10/453,562, filed Jun. 3, 2003, which issued into U.S. Pat. No. 7,052,207 which is a continuation of Ser. No. 09/756,565, filed Jan. 8, 2001, which issued into U.S. Pat. No. 6,609,852, the contents of each are hereby incorporated by reference in its entirety.

BACKGROUND OF THE INVENTION

The present invention relates to an erosion control basin and drain that is used during construction for preventing debris and sediment from entering the storm sewer. A basin that is provided will fit into a frame that will be used for the normal storm sewer drain grate, and will provide for catching debris, yet permitting water to be drained out.

Presently, when road and utility construction is undertaken, particularly in new building developments, a frame is put into place at storm sewer drains that are along the curb and gutters of streets. These frames are mounted onto the storm sewer stand pipes that have been previously installed, and in the normal process, the gutters are then formed around these frames. The curb and gutter around the grate and the curb box are generally hand formed, and during this process waste concrete that may be troweled off during finishing, or dropped, will enter the storm sewer structure, and it must be removed at the end of the installation. Additionally, during construction, particularly in new developments, if heavy rains occur, a large amount of debris and silt will be washed into the storm sewers all to the detriment of environmental conditions.

It is, however, during the forming of the curb and gutter around the storm sewer grate and frame that when concrete is most likely to fall into the storm sewer. The present device provides a simple, easily used insert basin and drain to be supported on the frame during construction to catch concrete, and other debris.

SUMMARY OF THE INVENTION

The present invention relates to a drain catch basin formed in a suitable manner, that will fit into a storm sewer drain frame, and which will catch and retain concrete waste, and other debris. The catch basin has a center perforated tube forming a drain tube, that is covered with a filtration sock, or fine mesh, to filter out large debris but yet let water pass through for draining as necessary. The upper opening of the tube, which forms a standpipe type structure, is left open so that in cases where heavy rains or heavy runoff is present, and the water starts to back up, there is a larger opening for permitting draining without flooding the street. Additionally, for overflow, a curb box is provided. The curb box is a frame laterally offset from the grate frame and around which the curb is formed. The curb box forms a passageway which is also open to the storm sewer. The curb box is only partially blocked with a wall of the basin of the present invention, so that there is an open space above the wall to provide for overflow into the curb box.

The basin, with its drain capabilities is left in place until the turf or other landscaping has been established around the curb, and the curb has been formed.

DETAILED DESCRIPTION OF THE PREFERRED EMBODIMENTS

Figure 1:
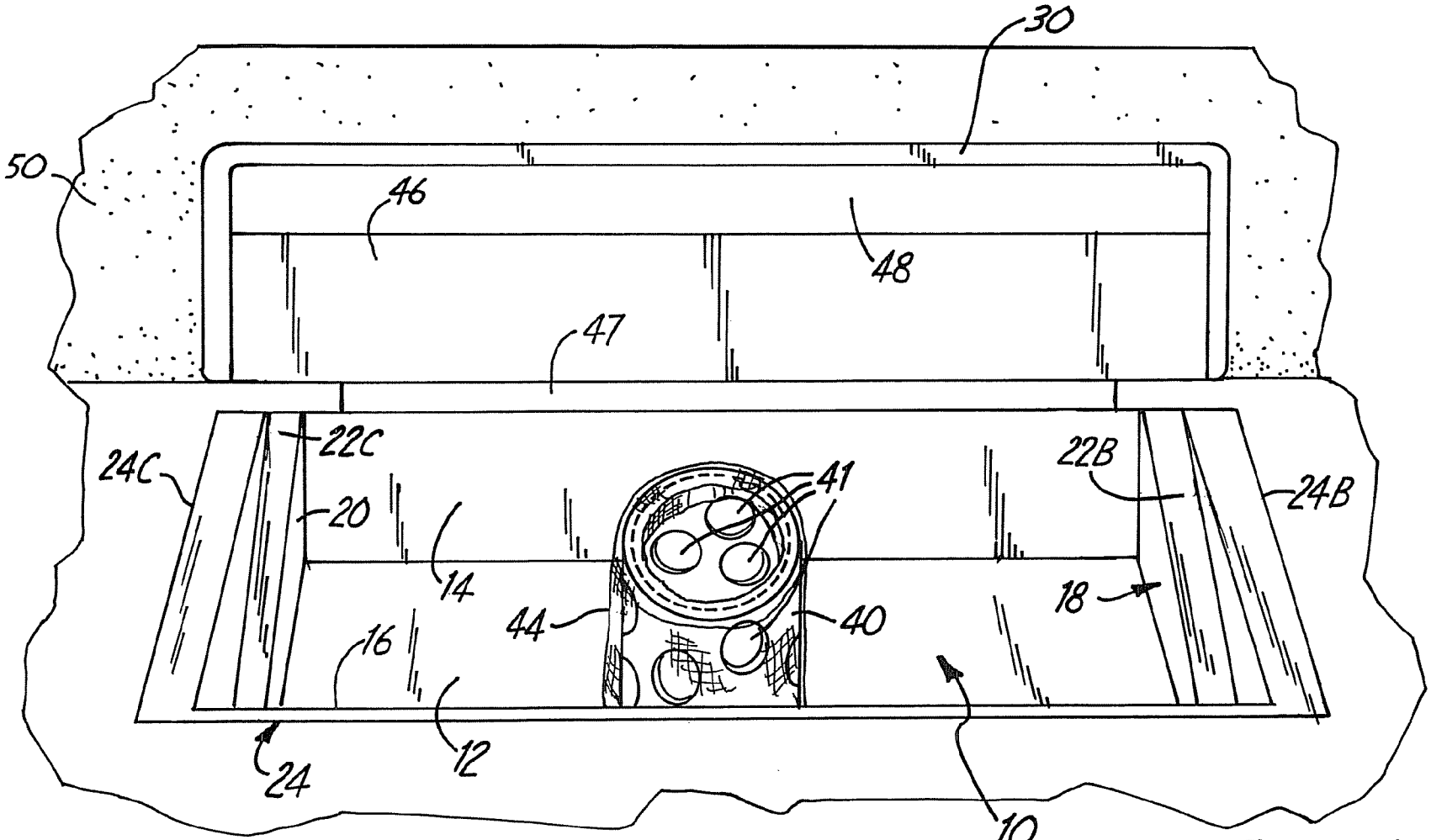
FIG. 1 is a top front perspective view of a catch basin made according to the present invention in a partially installed curb and gutter.
Figure 2:
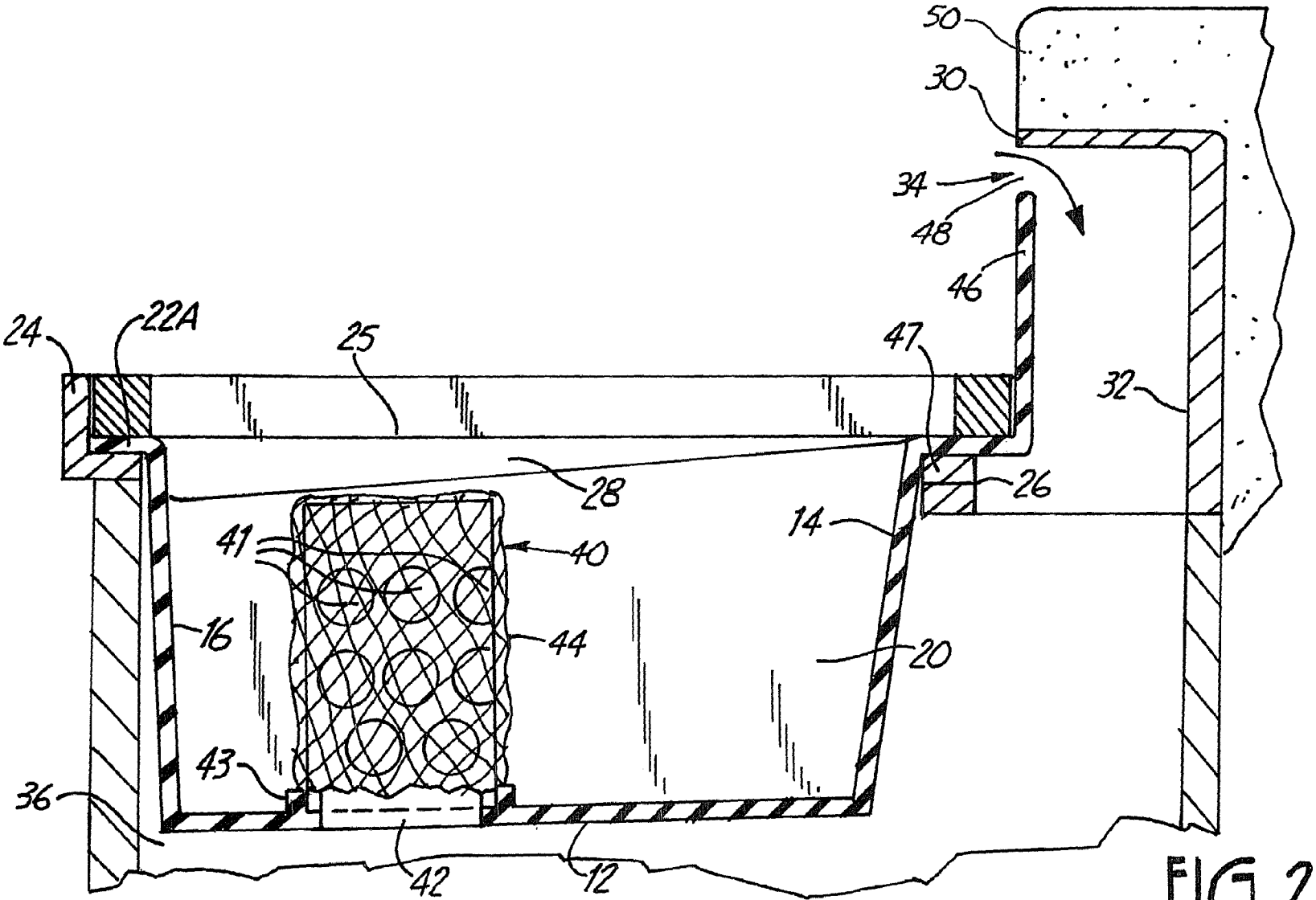
FIG. 2 is a schematic sectional view showing the catch basin installed in a frame, after using a curb box, and after a curb and gutter has been formed.
Figure 3:
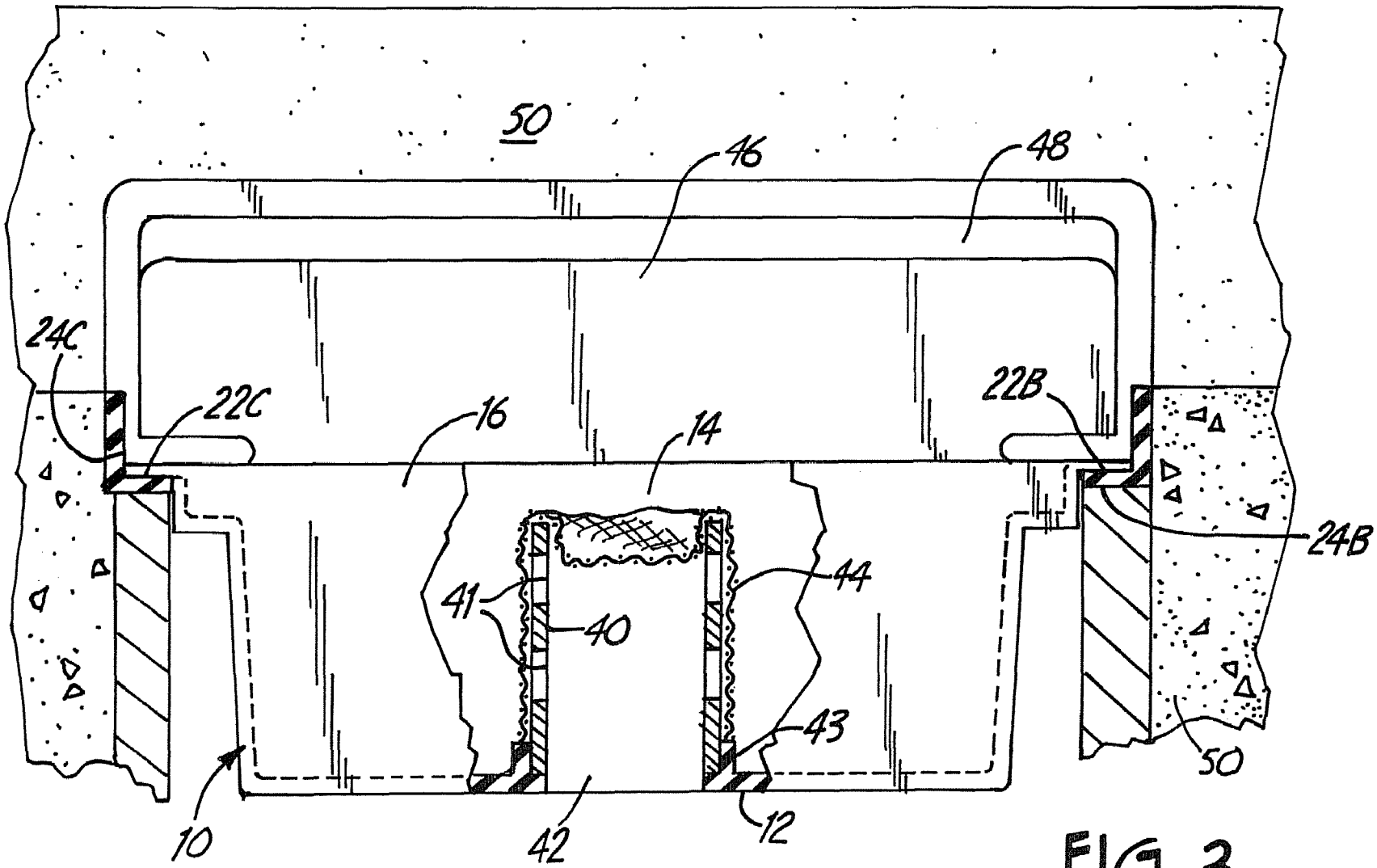
FIG. 3 is a front view of the catch basin of the present invention with parts broken away.

A catch basin forming an erosion control device is illustrated generally at 10, and made according to the present invention. The basin 10 is a open topped basin that has a bottom wall 12, a rear wall 14, a front wall 16, and side walls 18 and 20. The side walls and the front wall have flanges or lips 22 that are used for supporting the basin 10 in a frame 24 that is designed for containing a slated grate 25 for overlying the inlet to a storm sewer pipe shown schematically at 26. The frame 24 has a cross section shaped like an angle iron along the front and sides, and has a front member 24A that supports the flange 22A of the basin. The frame 24 has side members 24B and 24C which support flanges 22B and 22C. The rear cross member 26 of the frame 24 can be utilized. As shown a curb box 30 is part of the frame 24, and is made so that it will provide a shield wall 32 and an opening 34 leading into the storm sewer chamber 36.

The basin 10 has offset wall sections 28 between flanges 22B and 22C and the side walls that position the bottom wall 12 hold the bottom wall to be generally horizontal. A standpipe or drainpipe 40 is positioned to align over an opening 42 in the bottom wall 12. As shown the drainpipe 40 fits into a collar 43 formed on the bottom wall 12, and extends upwardly therefrom. The opening 42 at the bottom of the drain pipe 40 leads to the storm sewer pipe. The drainpipe 40 is a perforated plastic drain pipe with large holes 41 in it, and it is covered with a filter material or a filter sock 44 that is a mesh or other filter material that will filter out debris and sediment before the material enters into the interior of the drain 40. Water drains through the opening 42 into the storm sewer cavity 36.

The basin 10 can be made out of a suitable plastic material or formed metal, and the drainpipe 40 is then cemented in place or otherwise securely fastened. The collar 43 can be molded to the bottom wall 12, for holding the drainpipe in position, if desired.

The basin also has a sediment deflection wall shown at 46 at the rear or curb end. The plate 46 is offset from the rear wall with a flange 47 that can rest on frame cross member 26. The wall 46 fits into the inlet opening in the curb box 30 to partially block the opening. A space shown at 48 is left so that if serious flooding occurred, this space or gap would permit water to go through the curb box and into the storm sewer.

The top of the drain 40 is left uncovered, so that if water fills the basin it can overflow into the interior of the pipe, to take care of storms or excessive drainage.

When the curb and gutter is formed, which is shown in FIG. 1, at 50, it is made of concrete, and is hand formed around the curb box or other structure, after the frame 24 for the grate 25 has been put into place. In other words, the frame 24 is supported on the storm drain pipe 26, and the concrete curb and gutter 50 is formed around the frame.

The basin 10 is put into place on the frame 24 before the curb and gutter is formed, and if any concrete or sand, or the like from the formation of the curb is broken off or discarded, it will not go down the storm drain, but rather will be caught in the basin 10.

Additionally, runoff water that may be carrying debris or other materials will be prevented from going directly into the storm drain, by the standpipe 40 and filter sock 49 that is used in the basin 10.

The basin 10 forms an open topped receptacle, with the bottom wall, side walls, and front and rear walls as shown. The basin can be designed in shape so that it will fit into the various types of frames used for storm sewer grates, as well as the rectangular form shown. Storm sewer frame castings are available in many shapes and sizes, and each erosion control basin then would be designed to fit into the frame with which it is used.

The frame 24 for the drain is set into place on the previously installed storm sewer, and supported in place. Then the basin 10 is put into the frame 24, and is supported on the lips that extend around at least three walls. The rear wall of the basin can be supported on a cross member of the frame 24 as well. Then the curb and gutter 50 is formed around the frame for the storm drain, and the basin 10 acts as a trap for debris or material that may be loosened or dropped when the concrete work is being done.

The basin is permitted to stay in place until the landscaping is completed to collect debris, salt, and other material that may be washed into the drain opening. The basin can be removed and dumped if it fills. The basin is removed when construction is completed.

Although the present invention has been described with reference to preferred embodiments, workers skilled in the art will recognize that changes may be made in form and detail without departing from the spirit and scope of the invention.

What is claimed is:

1. An apparatus for positioning within an inlet to a storm sewer having a frame supporting a grate, and a curb box, the apparatus comprising:

a structure engaging the frame such that the structure is suspended beneath an area covered by the grate, the structure comprising a filtered outlet; and an inperforate deflecting wall attached to the structure and substantially across a length of the frame and extending upwardly into the curb box and behind the grate when positioned on the frame and wherein storm water enters the structure though the grate and the water flows though the filtered outlet to remove sediment and debris from the water entering the storm sewer and wherein the deflecting wall extends into the curb box to deflect water into the structure while allowing water to overflow the deflecting wall in the event that the filtered outlet plugs or a street floods due to excessive amounts of water flowing into the sewer.

2. The apparatus of claim 1 and wherein the structure extends beneath substantially all of the area of the storm sewer covered by the grate.

3. The apparatus of claim 1 and wherein the structure is sufficient to support a weight of the water within the structure and/or a weight of the debris retained in the structure as the water is filtered.

4. The apparatus of claim 3 and wherein the structure is constructed of metal or plastic.

5. The apparatus of claim 1 and wherein the structure comprises a basin.

6. The apparatus of claim 1 and wherein the structure comprises a bottom wall and a plurality of side walls extending from the bottom wall and wherein the bottom wall includes the opening for discharging the filtered water from the apparatus.

7. The apparatus of claim 1 and further comprising a filter supported by the structure wherein the filter allows water to flow therethrough prevents debris and sediment from entering the storm sewer.

8. The apparatus of claim 7 and wherein the filter comprises a stand pipe having perforations therein.

9. An apparatus for positioning within an inlet to a storm sewer having a frame supporting a grate, and a curb box, the apparatus comprising:

a structure engaging the frame such that the structure is suspended beneath an area covered by the grate, the structure comprising a filtered outlet, wherein the structure comprises a bottom wall and a plurality of side walls extending from the bottom wall and wherein the bottom wall includes the opening for discharging the filtered water from the apparatus; and a deflecting wall attached to the structure and substantially across a length of the frame and extending upwardly into the curb box and behind the grate when positioned on the frame and wherein storm water enters the structure through the grate and the water flows through the filtered outlet to remove sediment and debris from the water entering the storm sewer and wherein the deflecting wall extends into the curb box to deflect water into the structure while allowing water to overflow the deflecting wall in the event that the filtered outlet plugs or a street floods due to excessive amounts of water flowing into the sewer.

10. The apparatus of claim 9 and wherein the structure extends beneath substantially all of the area of the storm sewer covered by the grate.

11. The apparatus of claim 9 and wherein the structure is sufficient to support a weight of the water entering the structure and/or a weight of the debris retained in the structure as the water is filtered.

12. The apparatus of claim 11 and wherein the structure is constructed of metal or plastic.

13. The apparatus of claim 9 and wherein the structure comprises a basin.

14. The apparatus of claim 9 and further comprising a filter supported by the structure wherein the filter allows water to flow therethrough prevents debris and sediment from entering the storm sewer.

15. The apparatus of claim 14 and wherein the filter comprises a stand pipe having perforations therein.

16. An apparatus for positioning within an inlet to a storm sewer having a frame supporting a grate, and a curb box, the apparatus comprising:

a structure engaging the frame such that the structure is suspended beneath an area covered by the grate, the structure comprising a filtered outlet and a first overflow mechanism; and a deflecting wall attached to the structure and substantially across a length of the frame and extending upwardly into the curb box and behind the grate when positioned on the frame and wherein storm water enters the structure through the grate and the water flows though the filtered outlet to remove sediment and debris from the water entering the storm sewer and wherein the deflecting wall extends into the curb box to deflect water into the structure wherein the first overflow mechanism is positioned below the grate to allow unfiltered water to flow into the storm sewer.

17. The apparatus of claim 16 and wherein the deflecting wall extends into the curb box to deflect water into the structure while allowing water to overflow the deflecting wall to provide a second overflow mechanism to allow unfiltered water into the storm sewer in the event that the first overflow mechanism does not have the capacity to discharge the unfiltered water and water begins to flood the street.

18. The apparatus of claim 16 and wherein the structure extends beneath substantially all of the area of the storm sewer covered by the grate.

19. The apparatus of claim 16 and further comprising a filter supported by the structure wherein the filter allows water to flow therethrough prevents debris and sediment from entering the storm sewer.

* * * * *

US007488414C1

(12) EX PARTE REEXAMINATION CERTIFICATE (7983rd)

United States Patent
Wimberger

(10) Number: US 7,488,414 C1
(45) Certificate Issued: Jan. 11, 2011

(54) STORM WATER FILTER FOR POSITIONING WITHIN A STORM WATER INLET

(75) Inventor: Brian J. Wimberger, Minneapolis, MN (US)

(73) Assignee: Wimco, LLC, Shakopee, MN (US)

Reexamination Request:
No. 90/009,716, Apr. 5, 2010

Reexamination Certificate for:

| | |
|---|---|
| Patent No.: | **7,488,414** |
| Issued: | **Feb. 10, 2009** |
| Appl. No.: | **12/136,363** |
| Filed: | **Jun. 10, 2008** |

Related U.S. Application Data

(63) Continuation of application No. 11/440,427, filed on May 24, 2006, now Pat. No. 7,396,471, which is a continuation of application No. 10/453,562, filed on Jun. 3, 2003, now Pat. No. 7,052,207, which is a continuation of application No. 09/756,565, filed on Jan. 8, 2001, now Pat. No. 6,609,852.

(51) Int. Cl.
*E03F 5/14* (2006.01)

(52) U.S. Cl. ..... 210/163; 210/164; 210/170.03; 210/434; 210/474; 404/4; 405/41

(58) Field of Classification Search ..... None
See application file for complete search history.

(56) References Cited

U.S. PATENT DOCUMENTS

| | | | |
|---|---|---|---|
| 2,065,009 | A | 12/1936 | Mallet |
| 5,573,349 | A | 11/1996 | Paoluccio |
| 6,274,036 | B1 | 8/2001 | Ellis |
| 6,294,095 | B1 | 9/2001 | Lewis |

*Primary Examiner*—Terrence R Till

(57) ABSTRACT

An erosion control basin is a molded open topped receptacle that has support flanges that will support the basin on the interior of a storm drain grate frame. A filter is formed around an upright perforated drain pipe that is on the interior of the basin and which opens to an outlet. The basin catches debris and silt but permits water to drain out. The top of the drainpipe is left open for overflow purposes.

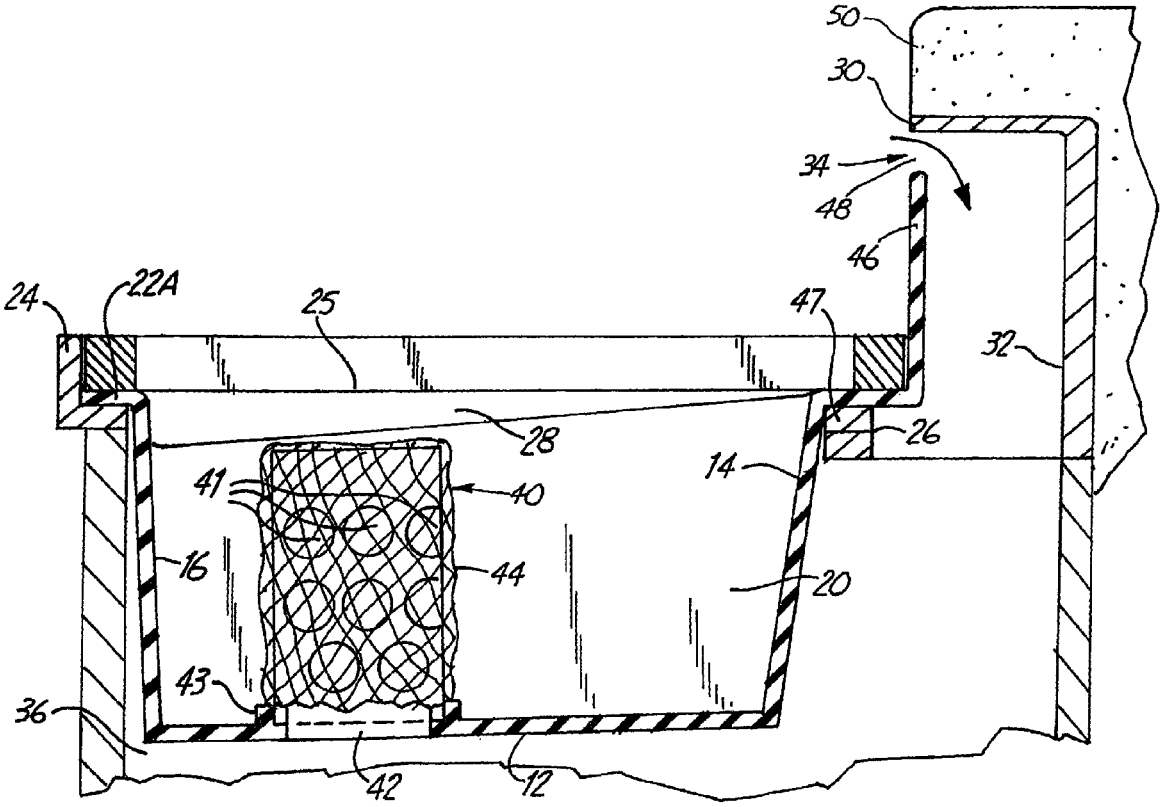

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-19 is confirmed.

* * * * *

US007488414C2

(12) EX PARTE REEXAMINATION CERTIFICATE (10100th)

United States Patent
Wimberger

(10) Number: US 7,488,414 C2
(45) **Certificate Issued: *Apr. 3, 2014**

(54) STORM WATER FILTER FOR POSITIONING WITHIN A STORM WATER INLET

(76) Inventor: Brian J. Wimberger, Minneapolis, MN (US)

Reexamination Request:
No. 90/011,700, May 19, 2011

Reexamination Certificate for:

| | |
|---|---|
| Patent No.: | **7,488,414** |
| Issued: | **Feb. 10, 2009** |
| Appl. No.: | **12/136,363** |
| Filed: | **Jun. 10, 2008** |

Reexamination Certificate C1 7,488,414 issued Jan. 11, 2011

( * ) Notice: This patent is subject to a terminal disclaimer.

Related U.S. Application Data

(63) Continuation of application No. 11/440,427, filed on May 24, 2006, now Pat. No. 7,396,471, which is a continuation of application No. 10/453,562, filed on Jun. 3, 2003, now Pat. No. 7,052,207, which is a continuation of application No. 09/756,565, filed on Jan. 8, 2001, now Pat. No. 6,609,852.

(51) Int. Cl.
*E03F 5/14* (2006.01)

(52) U.S. Cl.
USPC ..... 210/163; 210/164; 210/170.03; 210/434; 210/474; 404/4; 405/41

(58) Field of Classification Search
USPC ..... 210/170.03; 404/4, 5; 405/48, 87
See application file for complete search history.

(56) References Cited

To view the complete listing of prior art documents cited during the proceeding for Reexamination Control Number 90/011,700, please refer to the USPTO's public Patent Application Information Retrieval (PAIR) system under the Display References tab.

*Primary Examiner* — Robert M. Fetsuga

(57) ABSTRACT

An erosion control basin is a molded open topped receptacle that has support flanges that will support the basin on the interior of a storm drain grate frame. A filter is formed around an upright perforated drain pipe that is on the interior of the basin and which opens to an outlet. The basin catches debris and silt but permits water to drain out. The top of the drainpipe is left open for overflow purposes.

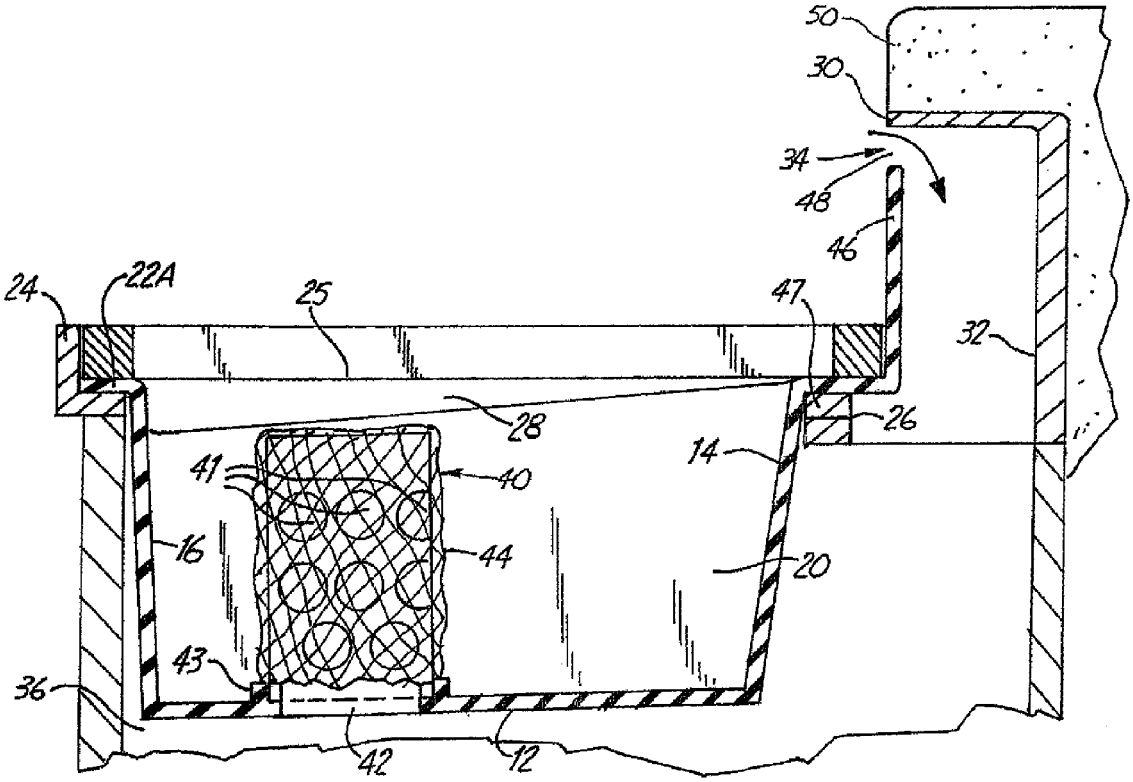

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-7 and 9-14 are cancelled.

Claims 8 and 15-19 were not reexamined.

* * * * *